US011350708B2

(12) United States Patent
Yagyu

(10) Patent No.: US 11,350,708 B2
(45) Date of Patent: Jun. 7, 2022

(54) FASTENER STRINGER

(71) Applicant: YKK Corporation, Tokyo (JP)

(72) Inventor: Akihiro Yagyu, Kurobe (JP)

(73) Assignee: YKK Corporation, Tokyo (JP)

( * ) Notice: Subject to any disclaimer, the term of this patent is extended or adjusted under 35 U.S.C. 154(b) by 396 days.

(21) Appl. No.: 16/616,386

(22) PCT Filed: May 26, 2017

(86) PCT No.: PCT/JP2017/019788
§ 371 (c)(1),
(2) Date: Nov. 22, 2019

(87) PCT Pub. No.: WO2018/216217
PCT Pub. Date: Nov. 29, 2018

(65) Prior Publication Data

US 2020/0138151 A1 May 7, 2020

(51) Int. Cl.
*A44B 19/34* (2006.01)
*D03D 1/00* (2006.01)
*A44B 19/54* (2006.01)

(52) U.S. Cl.
CPC ..... *A44B 19/346* (2013.01); *A44B 19/54* (2013.01); *D03D 1/00* (2013.01); *D10B 2501/0631* (2013.01)

(58) Field of Classification Search
CPC ..... A44B 19/346; A44B 19/54
See application file for complete search history.

(56) References Cited

U.S. PATENT DOCUMENTS 4,354,532 A 10/1982 Tsubata
5,472,019 A * 12/1995 Shimono ..... D03D 1/00 24/392
6,330,892 B1 12/2001 Shimono
(Continued)

FOREIGN PATENT DOCUMENTS

CN 1270243 A 10/2000
CN 103781378 A 5/2014
(Continued)

OTHER PUBLICATIONS

Office Action, Japanese Patent Application No. 2019-519939, dated Apr. 21, 2020, 7 pages.
(Continued)

*Primary Examiner* — Robert Sandy
(74) *Attorney, Agent, or Firm* — Kilpatrick Townsend & Stockton LLP

(57) ABSTRACT

A fastener stringer has a fastener tape provided with a tape main body portion and an element attaching portion and a plurality of fastener elements fixed by weaving to the element attaching portion of the fastener tape at the same time of weaving of the fastener tape, and is provided with a weaving structure with one pitch per one-rotation. A weft yarn of the fastener tape has a fineness larger than that of at least a part of a warp yarns disposed in the tape main body portion. Thereby, the productivity of the fastener stringer can be increased to reduce the cost. Further, the density of the weft yarn in the fastener tape can be increased, and the fastener tape can be less likely to be misaligned.

6 Claims, 5 Drawing Sheets

(56) References Cited

U.S. PATENT DOCUMENTS

| | | | | |
|---|---|---|---|---|
| 7,152,438 | B2 * | 12/2006 | Matsuda | A44B 19/56 66/195 |
| 7,520,304 | B2 * | 4/2009 | Shimono | A44B 19/54 139/384 B |
| 9,339,087 | B2 * | 5/2016 | Nishida | A44B 19/54 |
| 2001/0027821 | A1 | 10/2001 | Shimono | |
| 2002/0157172 | A1 | 10/2002 | Matsushima et al. | |
| 2004/0173276 | A1 * | 9/2004 | Horikawa | A44B 19/346 139/384 B |
| 2013/0232737 | A1 | 9/2013 | Shimono | |
| 2014/0223699 | A1 | 8/2014 | Tsuzuyama | |

FOREIGN PATENT DOCUMENTS

| | | | |
|---|---|---|---|
| JP | S56-22003 | U | 2/1981 |
| JP | 2000-303298 | A | 10/2000 |
| JP | 2001-245709 | A | 9/2001 |
| JP | 2002-085113 | A | 3/2002 |
| JP | 2002-317347 | A | 10/2002 |
| JP | 3208550 | U | 1/2017 |
| WO | 2012-042595 | A1 | 4/2012 |

OTHER PUBLICATIONS

Search Report, European Patent Application No. 17911348.5, dated Dec. 14, 2020, 7 pages.

Office Action, Chinese Patent Application No. 201780090408.4, dated Aug. 3, 2021, 15 pages.

Office Action, Indonesian Patent Application No. P00201912128, dated Jun. 11, 2021, 10 pages.

International Search Report, PCT Application No. PCT/JP2017/019788, dated Aug. 29, 2017.

Examination as to Substance, Vietnamese Patent Application No. 1-2019-07334, dated Feb. 28, 2022, 4 pages.

* cited by examiner

FASTENER STRINGER

TECHNICAL FIELD

The present invention relates to a fastener stringer in which fastener elements are fixed by weaving to a fastener tape at the same time of weaving of the fastener tape.

BACKGROUND ART

As one of the fastener stringers, a fastener stringer in which a plurality of coiled fastener elements molded continuously from a synthetic resin monofilament are woven and fixed along one side edge part of a fastener tape at the same time of weaving the fastener tape is known. This kind of fastener stringer is commonly called as a woven fastener stringer.

In a case of such a woven fastener stringer, the fastener tape is woven using a weft yarn and a plurality of warp yarns. The fastener tape has a tape main body portion attached to a fastener attached member in products such as clothing and an element attaching portion which extends in a tape width direction from one side edge part of the tape main body portion and to which the fastener elements are fixed.

Such a woven fastener stringer is described in, for example, Japanese Patent Application Publication Nos. 2000-303298 A (Patent Document 1) and 2002-85113 A (Patent Document 2). In Patent Document 1, for example, a fastener stringer 70 shown in FIG. 4 is described as one of Embodiments.

The fastener stringer 70 shown in FIG. 4 has a fastener tape 71 woven with a weft yarn 81 and a plurality of warp yarns 82, and a plurality of coiled fastener elements 72 woven and fixed to the fastener tape 71. In this case, the fastener tape 71 has an element attaching portion 71*a* to which the fastener elements 72 are attached and a tape main body portion 71*b* attached to a fastener attached member. Further, as the weft yarn 81 and the warp yarn 82 forming the fastener tape 71, yarns having the same thickness are generally used.

In the element attaching portion 71*a* of the fastener tape 71 shown in FIG. 4, a plurality of warp yarns (warp yarns for fixing elements) 82 fixing the fastener elements 72, and a weft yarn 81 forming a woven texture by intersecting with these warp yarns 82 is disposed. In addition, in the element attaching portion 71*a*, a plurality of fastener elements 72 continuously molded in a coiled shape are inserted and fixed between the warp yarns 82 of the element attaching portion 71*a* at the time of weaving the element attaching portion 71*a*.

Each of the fastener elements 72 has a coupling head portion disposed to be protruded from the fastener tape 71, an upper leg portion and a lower leg portion extending inward of the tape from the coupling head portion along a tape width direction, and a connecting portion connecting between an end part of the upper leg portion (or lower leg portion) and an end part of the lower leg portion (or upper leg portion) of another fastener element 72 adjacent in the tape length direction.

In a case of the fastener stringer 70 shown in FIG. 4, particularly, it has a weaving structure that each time the weft yarn 81 is inserted, one fastener element 72 is inserted and fixed together with the weft yarn 81. Such a weaving structure is called as a weaving structure with one pitch per one-rotation, since the fastener element 72 is inserted and fixed in one pitch for each rotation of the weft yarn 81 forming the fastener tape 71.

The tape main body portion 71*b* of the fastener tape 71 is formed using a weft yarn 81 continuously disposed from the element attaching portion 71*a* and a plurality of warp yarns 82. Further, a weft yarn returning end portion 74 is disposed at an outer side end part of the tape main body portion 71*b* opposite to the element attaching portion 71*a*. The weft yarn returning end portion 74 is formed such that a returning loop portion 73 formed of the weft yarn 81 is hooked to another returning loop portion 73 of the weft yarn 81 to be inserted at a next position and a plurality of the returning loop portions 73 are connected in a warp direction.

Furthermore, in the fastener stringer 70 of FIG. 4, two loops 75 are formed on the weft yarn 81 every time the weft yarn 81 is inserted, and these two loops 75 are respectively interlaced with two loops 75 formed on the weft yarn 81 at a next weft insertion position to form two loop rows 76 using a knitting needle appropriately disposed in a loom weaving the fastener tape 71. These two loop rows 76 are continuously formed along a warp direction, respectively.

The fastener stringer 70 of Patent Document 1 as described above is woven with a weaving structure with one pitch per one-rotation, thereby the density of the weft yarn 81 is low. However, two loop rows 76 are formed in the tape main body portion 71*b* of the fastener tape 71, therefore, there is an advantage that positional displacement of the weave at the tape side edge portion (outer side tape end edge part) on the weft yarn returning end portion 74 side in the tape main body portion 71*b* is unlikely to occur. In the following description, the positional displacement of the weave may be simply abbreviated as a misalignment.

Further, a fastener stringer 90 as shown in FIG. 5 is described in Patent Document 1 as another Embodiment.

The fastener stringer 90 shown in FIG. 5 has a fastener tape 91 woven with a weft yarn 81 and a plurality of warp yarns 82, and a plurality of coiled fastener elements 92 woven and fixed to the fastener tape 91. The fastener tape 91 has an element attaching portion 91*a* and a tape main body portion 91*b*, and the plurality of coiled fastener elements 92 are fixed by weaving to the element attaching portion 91*a*.

Further, the fastener stringer 90 in FIG. 5 is formed with a weaving structure with one pitch per two-rotation in which one fastener element 92 is inserted and fixed each time the weft yarn 81 is inserted twice. By thus increasing the number of insertions of the weft yarn 81 with respect to the fastener element 92, the density of the weft yarn 81 can be made higher than in the case of the fastener stringer 70 shown in FIG. 4, and the woven texture can be formed densely.

Also in the fastener stringer 90 of FIG. 5, a weft yarn returning end portion 94 is formed at an outer side tape end edge part of the fastener tape 91. Further, two loop rows 96 are continuously formed along a warp direction in the tape main body portion 91*b* of the fastener tape 91.

In such a fastener stringer 90 shown in FIG. 5, the two loop rows 96 are formed in the tape main body portion 91*b*, and the density of the weft yarn 81 is increased due to a weaving structure with one pitch per two-rotation. Therefore, in the outer side tape end edge part of the tape main body portion 91*b* shown in FIG. 5, misalignment can be to occur yet than in the case of the fastener stringer 70 shown in FIG. 4.

On the other hand, in Patent Document 2, a fastener stringer in which coiled fastener elements are woven and fixed to an element attaching portion of a fastener tape, and the fastener tape and the fastener elements are woven with a weaving structure with one pitch per one-rotation is described.

In the fastener stringer of Patent Document 2, a monofilament thicker than the other warp yarn for fixing elements is used as a part of a plurality of warp yarns for fixing elements forming the element attaching portion of the fastener tape. Particularly in this case, the warp yarn formed of the thick monofilament is used for at least one warp yarn for fixing elements disposed on a connecting portion side of the fastener element among the plurality of warp yarns for fixing elements which fixes the fastener elements.

According to the fastener stringer of Patent Document 2 as above, due to the warp yarn for fixing elements formed of the thick monofilament, the force for tightening the upper leg portion and the lower leg portion of the fastener element is larger than the force for tightening the upper leg portion and the lower leg portion with the other warp yarns for fixing elements.

As a result, since the fastener elements are fixed along the side edge part of the fastener tape uniformly at constant pitches, the slide fastener can be smoothly opened and closed by the slider. Further, it is possible to slightly enlarge or reduce a distance between the coupling head portions of the fastener elements adjacent in the tape length direction, therefore, the coupling operation of the right and left fastener elements can be smoothly performed.

PRIOR ART DOCUMENT

Patent Documents

Patent Document 1: 2000-303298 A
Patent Document 2: 2002-085113 A

SUMMARY OF INVENTION

Problems to be Solved by the Invention

In the case of the fastener stringer 90 shown in FIG. 5, for example, since the fastener stringer 90 is woven with the weaving structure with one pitch per two-rotation as above, the fastener tape 91 having a high density of weft yarn 81 is formed. In addition, by adopting the weaving structure with one pitch per two-rotation, the tape main body portion 91*b* of the fastener tape 91 can be formed with various woven textures, and the fastener tape 91 can have versatility.

However, when forming the fastener stringer 90 with the weaving structure with one pitch per two-rotation, compared to the case of forming the fastener stringer 70 with the weaving structure with one pitch per one-rotation as shown in FIG. 4, for example, the number of insertions (the number of weft insertions) of the weft yarn 81 in a weaving process of the fastener tape 91 is doubled. Therefore, the productivity of the fastener stringer 90 is reduced and the manufacturing cost is increased. Further, the increase in the density of the weft yarn 81 may interfere with the weight reduction of the fastener stringer 90, and it may also affect the flexibility of the fastener stringer 90.

On the contrary, in the case of the fastener stringer 70 shown in FIG. 4 and the fastener stringer described in Patent Document 2, since a weaving structure with one pitch per one-rotation is adopted, the productivity can be increased and the manufacturing cost can be reduced compared to the case of the fastener stringer 90 shown in FIG. 5.

However, in the fastener stringer formed with the weaving structure with one pitch per one-rotation, since the woven texture of the fastener tape (particularly the woven texture of the tape main body portion) is coarser than that of the weaving structure with one pitch per two-rotation, there is a problem that misalignment of the fastener tape is likely to occur. That is, in a case that the weave of the tape main body portion in the fastener tape is coarse, and when the slide fastener is attached to the fastener attached member and used, the tape main body portion of the fastener tape is likely to be misaligned to a large extent due to a lateral pulling force generated on the fastener stringer at the time of opening or closing the slide fastener.

Such a misalignment occurred in the tape main body portion of the fastener tape leads to reduced tape strength and abrasion resistance of the fastener tape, and the fastener tape is likely to be damaged due to yarn breakage and the like. As a result, there is a possibility that the life (period of use) of the slide fastener may be shortened.

The present invention has been made in view of the above conventional problems, and a specific object of the invention is to provide a woven fastener stringer which can be manufactured at a low cost by adopting the weaving structure with one pitch per one-rotation capable of ensuring high productivity and which can make the tape main body portion less likely to be misaligned, and further to provide the woven fastener stringer which is expected to reduce the weight and to improve the flexibility of the fastener stringer.

Means for Solving the Problems

In order to achieve the above object, a fastener stringer provided by the present invention has a fastener tape woven by a weft yarn and a plurality of warp yarns and a plurality of continuous fastener elements fixed by weaving to the fastener tape along a tape length direction at the same time of weaving the fastener tape, in which the fastener tape is provided with a tape main body portion and an element attaching portion which extends in a tape width direction from one side edge part of the tape main body portion and to which the fastener elements are fixed, and the fastener stringer having a weaving structure in which the weft yarn is inserted once for each pitch of the fastener elements characterized in that the weft yarn has a fineness larger than at least a part of the warp yarns disposed in the tape main body portion of the fastener tape.

In the fastener stringer of the present invention as above, it is preferable that the warp yarn disposed in the tape main body portion has a first warp yarn having a predetermined fineness and a second warp yarn having a fineness larger than the first warp yarn, and the weft yarn has a fineness larger than the first warp yarn.

In this case, it is further preferable that the tape main body portion has a thick yarn-continuing area in which a plurality of the second warp yarns are disposed continuously along the tape width direction.

It is further preferable that the fastener tape has a weft yarn returning end portion which is disposed at the other side edge part of the tape main body portion and at which the weft yarn forms a loop and returns, the thick yarn-continuing area is disposed in the tape width direction from a position of the warp yarn adjacent to the weft yarn returning end portion, and a thin yarn-continuing area in which a plurality of the first warp yarns are continuously disposed is disposed between the thick yarn-continuing area and the element attaching portion.

In the fastener stringer of the present invention, it is preferable that the weft yarn and the second warp yarn have a fineness twice as large as the fineness of the first warp yarn.

In this case, it is further preferable that the weft yarn and the second warp yarn have a configuration in which two yarns forming the first warp yarn are aligned.

In the fastener stringer of the present invention, it is preferable that a fineness of the weft yarn is 500 dtex or larger and 1000 dtex or smaller, a fineness of the first warp yarn is 166 dtex or larger and 500 dtex or smaller, and a fineness of the second warp yarn is 500 dtex or larger and 1000 dtex or smaller.

Effects of the Invention

The fastener stringer according to the present invention is a woven fastener stringer having a fastener tape provided with a woven texture and a plurality of continuous fastener elements fixed by weaving to the fastener tape along a tape length direction at the same time of weaving the fastener tape. The fastener tape of the present invention has a tape main body portion and an element attaching portion which are partitioned in a tape width direction, and the fastener elements are fixed to the element attaching portion of the fastener tape.

The fastener stringer of the present invention has a weaving structure in which the weft yarn is inserted once for each pitch of continuously formed fastener elements, in other words, a weaving structure with one pitch per one-rotation in which one fastener element is inserted and fixed each time the weft yarn is inserted once. Therefore, in the fastener stringer of the present invention, as compared to the fastener stringer 90 of FIG. 5 formed with the conventional weaving structure with one pitch per two-rotation, for example, it is possible to manufacture with high productivity by reducing the number of insertion of the weft yarn, therefore, significant cost reduction can be achieved.

Furthermore, in the fastener stringer of the present invention, at the same time as the fastener tape is formed with a weaving structure with one pitch per one-rotation, the thicker yarn than at least a part of warp yarns (specifically, a first warp yarn described later) disposed in the tape main body portion is used for the weft yarn of the fastener tape. Since the tape main body portion is formed using the weft yarn having such a large fineness, as compared with the fastener stringer 70 of FIG. 4 formed with the conventional weaving structure with one pitch per one-rotation, for example, the tape main body portion is formed to have higher density weft (in other words, the tape main body portion is formed with a dense structure). Thereby, it is possible to make the fastener tape less likely to be misaligned, so the lowering of the tape strength and of the abrasion resistance of the fastener tape can be suppressed. As a result, it is possible to provide a slide fastener having a long life that can be stably used over a long period of time at a low cost.

In such a fastener stringer of the present invention, a plurality of first warp yarns having a predetermined fineness and a plurality of second warp yarns having a fineness larger than the first warp yarn are disposed in the tape main body portion of the fastener tape as the warp yarns disposed in a warp direction. In this case, the fineness of the weft yarn of the fastener tape is larger than that of the first warp yarn.

Since the tape main body portion of the fastener tape is formed using two types of the first warp yarn and the second warp which are different in fineness (thickness) as above, the presence of the thick second warp yarn can further improve the tape strength and the abrasion resistance of the fastener tape, and at the same time, the presence of the thin second warp yarn can suppress the negative effect of using the thick second warp yarn.

That is, in a case that the tape main body portion is formed using only the thick second warp yarn, for example, large irregularities is likely to be formed on a tape top surface or a tape back surface of the tape main body portion. Therefore, it is considered that the appearance (appearance quality) of the fastener tape is lowered, or the touch of the fastener tape becomes worse. Moreover, it is also considered that the weight increase of the fastener tape or less flexibility of the fastener tape are caused.

On the contrary, since the tape main body portion of the fastener tape is formed using not only the second warp yarn but also the first warp yarn having a smaller fineness than the second warp yarn, lowering of the appearance (appearance quality) and of the touch as described above can be suppressed and the weight reduction and cost reduction of the fastener tape can be achieved. Further, the first warp yarn is disposed in the tape main body portion, the fastener tape can be provided with appropriate flexibility. That is, the two types of the warp yarns which are the first warp yarn having a smaller fineness than the weft yarn and the second warp yarn having a larger fineness than the first warp yarn are disposed in the tape main body portion of the fastener tape, so that advantages of using the first warp yarn such as good appearance and good touch and advantages of using the second warp yarn such as high tape strength and abrasion resistance can be provided in combination in a well-balanced manner.

In this case, the tape main body portion of the fastener tape has the thick yarn-continuing area in which the plurality of second warp yarns are continuously disposed in the tape width direction. Thereby, not only the density of the weft yarn but also the density of the warp yarn can be effectively increased in the thick yarn-continuing area of the tape main body portion, so that the misalignment can be further prevented.

Further, the fastener tape of the present invention has the weft yarn returning end portion which is disposed at the other side edge part of the tape main body portion and at which the weft yarn forms a loop and returns. In this case, the above-described thick yarn-continuing area in which the plurality of second warp yarns are continuously disposed is disposed so as to extend in the tape width direction from a position of the warp yarn adjacent to the weft yarn returning end portion of the fastener tape. In addition, the thin yarn-continuing area in which a plurality of thin first warp yarns are continuously disposed is disposed between the thick yarn-continuing area and the element attaching portion.

Thereby, when the slide fastener manufactured using the fastener stringer of the present invention is used by being attached to the fastener attached member, the position of a sewn portion at which the fastener tape and the fastener attached member are sewn together can be set to the position within the thick yarn-continuing area or in the vicinity of the thick yarn-continuing area of the tape main body portion. As a result, even when a lateral pulling force is applied to the slide fastener, the misalignment of the fastener tape can be suppressed to a small extent more effectively. Furthermore, by providing the thin yarn-continuing area in which the plurality of first warp yarn are continuously disposed in the tape main body portion of the fastener tape, good appearance and good touch of the fastener tape by use of the thin first warp yarn are obtained stably, and appropriate flexibility of the fastener tape can be provided.

Particularly in the fastener stringer of the present invention, the weft yarn and the second warp yarn have a fineness twice as large as the fineness of the first warp yarn. This ensures good appearance and good touch of the fastener tape, and effectively suppresses the occurrence of misalignment in the woven texture to stably ensure the appropriate tape strength and abrasion resistance of the fastener tape that can endure the use of the slide fastener.

In this case, the above-described weft yarn and the second warp yarn have a configuration in which two yarns forming the first warp yarn are aligned. Thereby, the fineness of the weft yarn and the second warp yarn can be certainly made larger than the fineness of the first warp yarn. In addition, it is possible to form the weft yarn and the second warp yarn using the same yarn as the first warp yarn, therefore, the manufacturing cost of the fastener stringer can be more effectively reduced.

In a preferred Embodiment of the fastener stringer of the present invention, the fineness of the weft yarn is 500 dtex or larger and 1000 dtex or smaller. The fineness of the first warp yarn is 166 dtex or larger and 500 dtex or smaller. The fineness of the second warp yarn is 500 dtex or larger and 1000 dtex or smaller. As long as the fastener stringer has the weft yarn, the first warp yarn, and the second warp yarn having the fineness in the above range, it is possible to effectively suppress the occurrence of misalignment in the woven texture of the fastener tape (particularly the tape main body portion), and to stably obtain good appearance and good touch of the fastener tape.

MODES FOR CARRYING OUT THE INVENTION

Hereinafter, a preferred Embodiment of the present invention will be described in detail with reference to the drawings. The present invention is not limited to the Embodiments described below, and various modifications can be made as long as they have substantially the same structure as the present invention and exhibit the same functional effects.

In the fastener stringer described in the following Embodiment, for example, a plurality of fastener elements fixed by weaving to the fastener tape are formed continuously by molding a monofilament in a coiled shape. The present invention is not limited thereto, however, a plurality of fastener elements may be formed continuously by molding a monofilament in a zig-zag shape. Further, a material of the weft yarn and the respective warp yarns configuring the fastener tape is not particularly limited, and the same yarn as that generally used in the conventional fastener stringer can be adopted.

Figure 1:
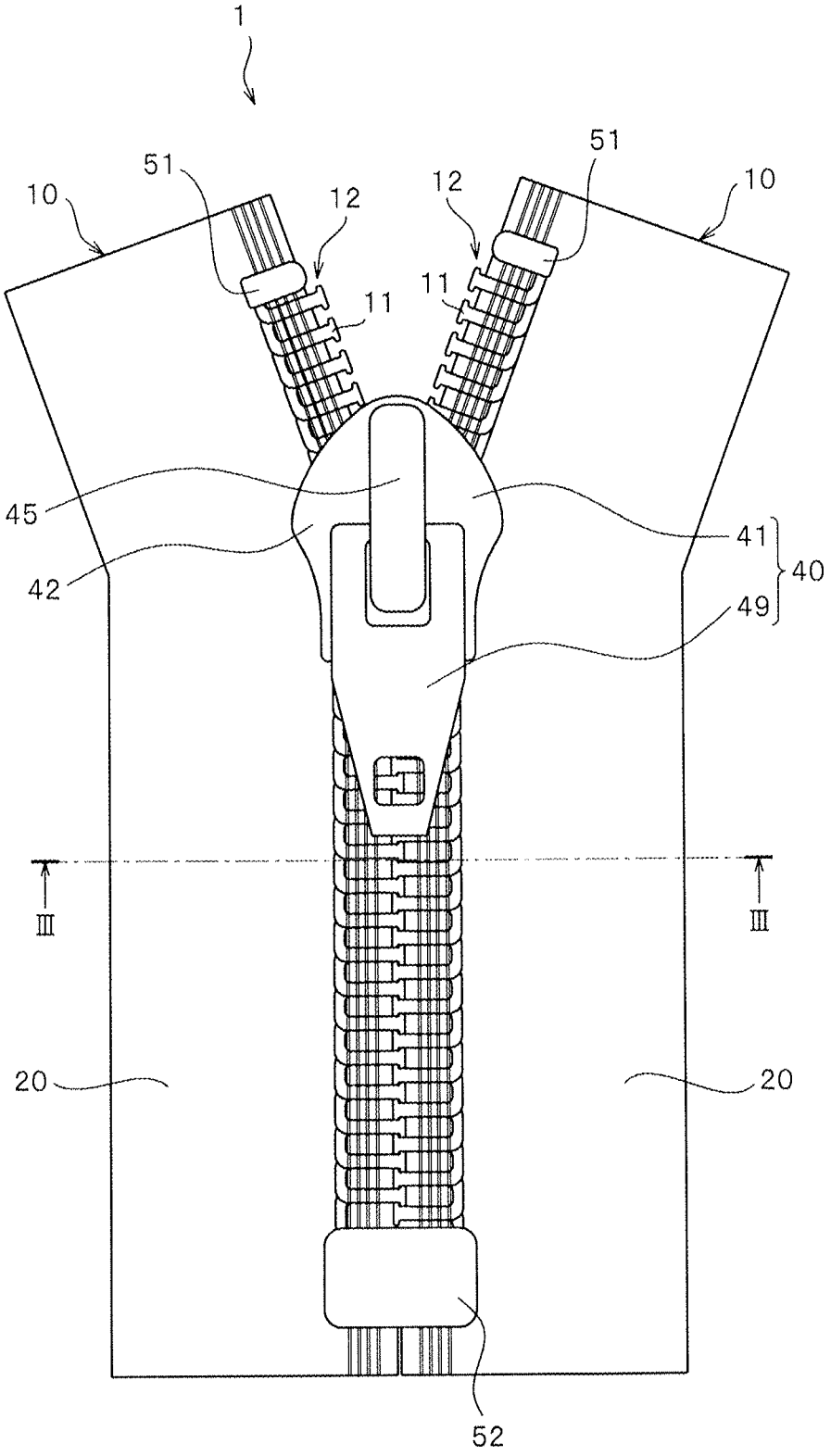
FIG. 1 is a plan view schematically showing a slide fastener having a fastener stringer according to Embodiment of the present invention.
Figure 2:
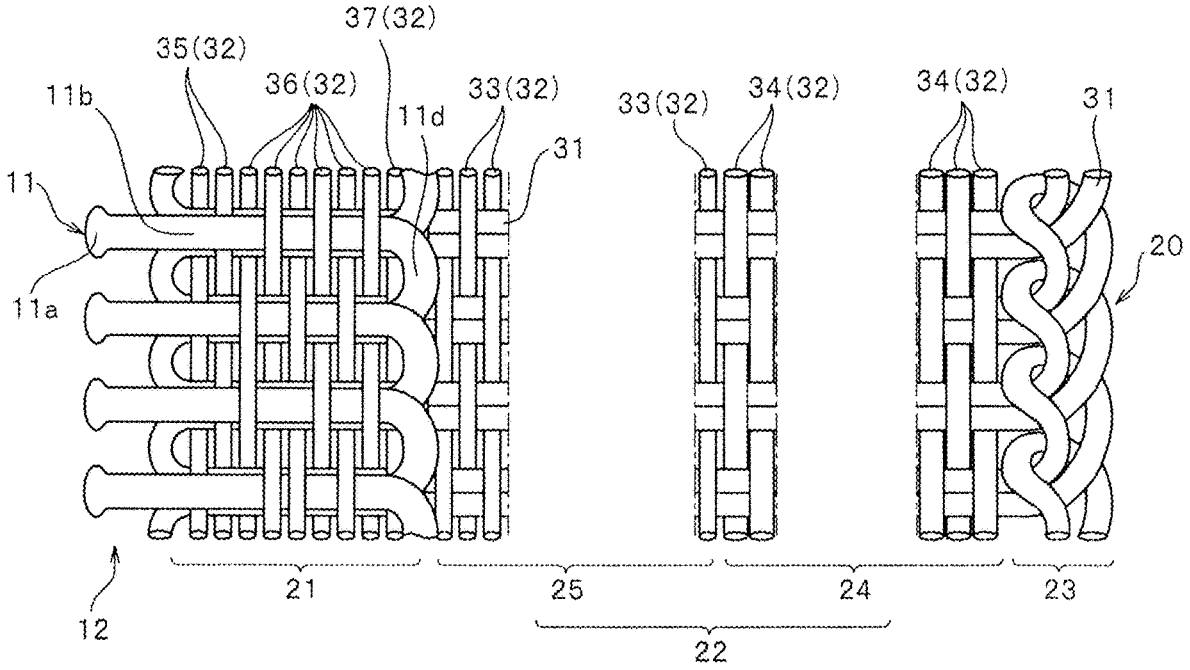
FIG. 2 is a schematic view schematically explaining a woven texture of the fastener stringer.
Figure 3:
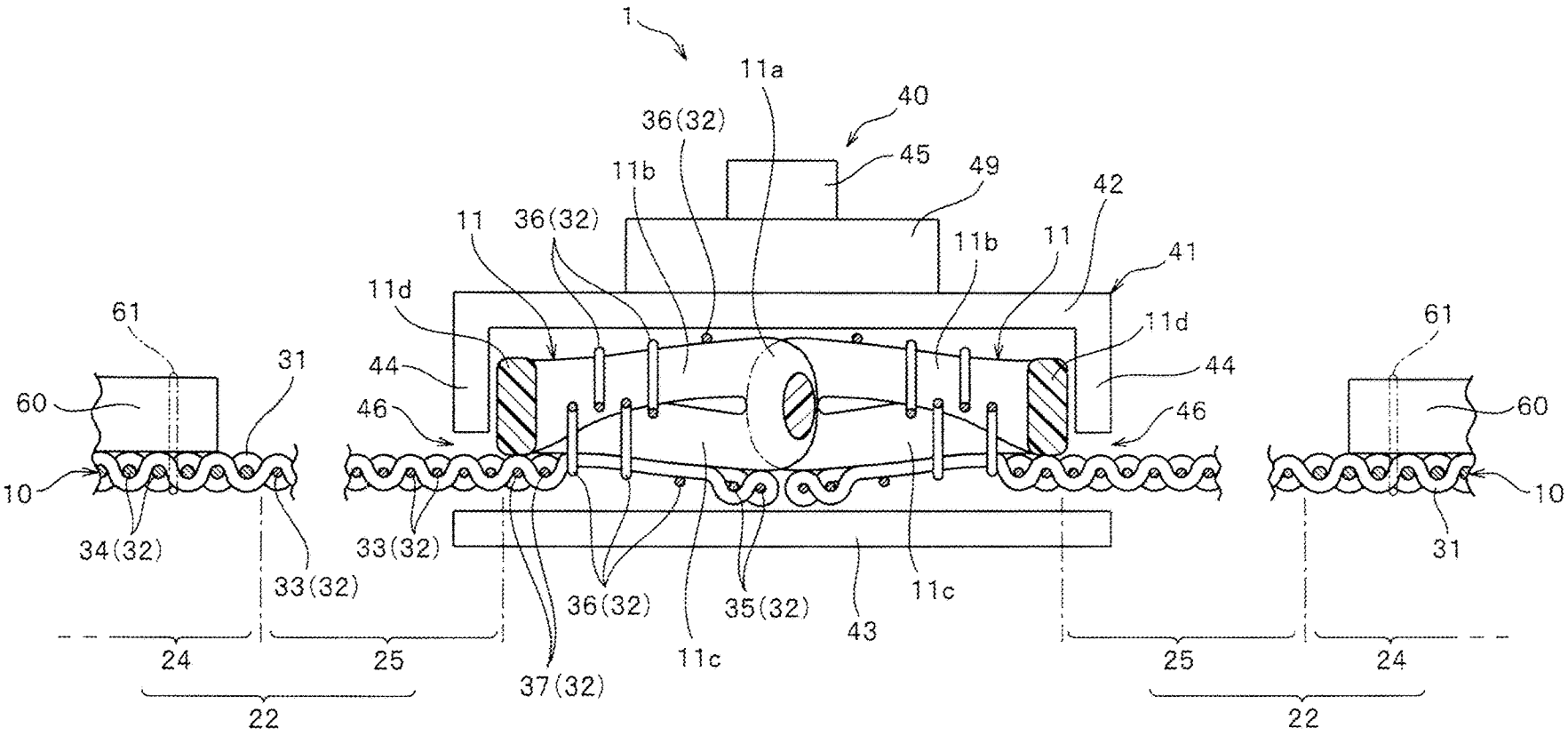
FIG. 3 is a cross-sectional view schematically showing a cross section of a position taken along line III-III shown in FIG. 1 in a state that the slide fastener is attached to the fastener attached member of a product.

Here, FIG. 1 is a plan view schematically showing a slide fastener having a fastener stringer according to the present Embodiment. FIG. 2 is a schematic view schematically explaining the woven texture of the fastener stringer. FIG. 3 is a cross-sectional view schematically showing a state in which the slide fastener is attached to a fastener attached member of a product.

In these figures, in order to make it easy to understand the features of the present invention, the woven structure (woven texture) of the fastener stringer is roughly shown. Actually, however, yarns having a predetermined thickness are used for the weft yarn and each warp yarn forming the fastener tape, and the woven texture of the fastener tape is formed densely in consideration of the function as a fastener stringer.

In the following explanation, a front and rear direction means a tape length direction of the fastener tape, and means the same linear direction as the sliding direction in which the slider slides. A right and left direction means a tape width direction of the fastener tape, and is a direction parallel to a tape surface of the fastener tape and perpendicular to the tape length direction. An upper and lower direction means a tape top and back direction perpendicular to the tape top surface and the tape back surface of the fastener tape. In the case of the present Embodiment, in particular, a direction perpendicular to the front and rear direction and the right and left direction and on a side the tab of the slider is disposed with respect to the fastener tape is an upper side, and a direction on the opposite side is a lower side. Further, a warp direction (warp yarn direction) is a length direction of the warp yarn, and the same direction as the tape length direction of the fastener tape.

A slide fastener 1 according to the present Embodiment has a right and left pair of fastener stringers 10 in which element rows 12 are respectively formed by weaving a plurality of fastener elements 11 into facing tape side edge parts (element attaching portions, described later) 21 of the right and left fastener tapes 20, a slider 40 attached along the right and left element rows 12 in a slidable manner, and a first stop 51 (also referred to as an upper stop) disposed adjacent to front end parts of the right and left element rows 12, and a second stop 52 (also referred to as a lower stop) adjacent to rear end parts of the right and left element rows 12 and connecting between the right and left fastener stringers 10.

The slide fastener 1 of the present Embodiment is characterized mainly in the fastener tape 20 of the fastener stringer 10, and the slider 40, the first stop 51, and the second stop 52 of the present Embodiment are formed in substantially the same manner as the slider, first stop, and second stop generally used in the conventional slide fastener.

The slider 40 of the present Embodiment is, for example, provided with a slider body 41 and a tab 49 rotatably held by the slider body 41. Further, as shown in FIG. 3, for example, the slider body 41 has an upper blade 42 and a lower blade 43 disposed parallel to each other, a connecting column (not shown) connecting a front end part of the upper blade 42 and a front end part of the lower blade 43, right and left upper flange portions 44 extending downward from right and left side edge parts of the upper blade 42, and a tab attaching portion 45 standing on an upper surface of the upper blade 42.

In this case, the right and left upper flange portions 44 of the slider body 41 are contacted with the fastener elements 11 attached to the right and left fastener stringers 10, thereby, the position of the fastener elements 11 in the tape width direction in the slider body 41 is controlled.

A front end part of the slider body 41 is provided with shoulder mouths disposed on both right and left sides of the connecting column, and a rear end part of the slider body 41 is provided with a rear mouth. Further, a substantially Y-shaped element guide pass is formed to connect the right and left shoulder mouths and the rear mouth so as to be surrounded by the upper blade 42, the lower blade 43, and the right and left upper flange portions 44. Furthermore, a tape insertion gap 46 for inserting the fastener tape 20 is formed between the right and left upper flange portions 44 and the lower blade 43 in the slider body 41.

The first stop 51 and the second stop 52 are provided to be continuous with the front and rear of the element rows 12 respectively in the right and left fastener tapes 20. Since the first stop 51 and the second stop 52 are disposed, the slider 40 can be prevented from falling off from the right and left element rows 12.

In the present invention, the structures, etc. of the slider 40, the first stop 51, and the second stop 52 can be arbitrarily changed, if necessary. Further, in the present invention, instead of providing the second stop 52 in the slide fastener 1, a separable rear end stop having an insert pin formed on one fastener tape 20, a box pin formed on the other fastener tape 20, and a box body integrally formed at a rear end part of the box pin and having an insertion concave portion into which the insert pin can be inserted may be provided.

The right and left fastener stringers 10 in the present Embodiment respectively have a fastener tape 20 woven using a weft yarn 31 and a plurality of warp yarns 32 and fastener elements 11 formed continuously in a coiled shape and woven into the fastener tape 20 at the same time of weaving the fastener tape 20. Further, the fastener stringer 10 of the present Embodiment is formed with so-called a weaving structure with one pitch per one-rotation in which one fastener element 11 is inserted and fixed together with the weft yarn 31 each time the weft yarn 31 is inserted once.

In the present Embodiment, each of the right and left fastener tapes 20 has an element attaching portion 21 to which the fastener elements 11 are fixed by weaving, and a tape main body portion 22 extending in the tape width direction from the element attaching portion 21. That is, the tape main body portion 22 and the element attaching portion 21 are disposed to be divided in the tape width direction by a predetermined boundary part (not shown) along the tape length direction of the fastener tape 20.

The tape main body portion 22 of the fastener tape 20 is a tape part which is overlapped and sewn to the fastener attached member 60 (for example, the fabric of the clothing) of the product when the slide fastener 1 is attached to the product such as the clothing. The tape main body portion 22 is, in a plan view of the fastener stringer 10 as viewed from above (see FIG. 2, for example), regarding the tape width direction, an area from a position of an element side end edge on a tape inner side in the fastener element 11 to a tape end edge (tape outer end edge) disposed on the opposite side to the tape end edge (tape inner end edge) on the side to which the fastener element 11 is attached.

The element attaching portion 21 of the fastener tape 20 is a tape side edge portion 21 extending in the tape width direction from one side edge (tape inner-side side edge) of the tape main body portion 22 toward the fastener stringer 10 on the coupling counterpart side. The element attaching portion (tape side edge portion) 21 is, regarding the tape width direction, an area from the position of the element side end edge on the tape inner side in the fastener element 11 to the above-mentioned tape inner end edge of the fastener tape 20.

The plurality of fastener elements 11 in the present Embodiment are formed to connect continuously in the tape length direction by molding a synthetic resin monofilament into a coiled shape. Each fastener element 11 has a coupling head portion 11*a*, an upper leg portion 11*b* and a lower leg portion 11*c* extending in the tape width direction from the coupling head portion 11*a*, and a connecting portion 11*d* extending from the upper leg portion 11*b* or the lower leg portion 11*c* to be connected to the fastener element 11 adjacent in the tape length direction.

The coupling head portion 11*a* of the fastener element 11 is formed in the upper and lower direction so as to connect the upper leg portion 11*b* and the lower leg portion 11*c*, and is provided with a bulged portion bulging in the front and rear direction at an intermediate part in the upper and lower direction. The upper leg portion 11*b* extends toward the tape width direction from an upper end part of the coupling head portion 11*a*. The lower leg portion 11*c* extends toward the fastener width direction substantially in parallel with the upper leg portion 11*b* from a lower end part of the coupling head portion 11*a*.

The connecting portion 11*d* connects the upper leg portion 11*b* of each fastener element 11 and the lower leg portion 11*c* of the fastener element 11 adjacent to one of the fastener elements 11 in the front and rear direction (in other words, connects the lower leg portion 11*c* of each fastener element 11 and the upper leg portion 11*b* of the fastener element 11 adjacent to the other of the fastener elements 11 in the front and rear direction).

Each fastener element 11 is fixed to the element attaching portion 21 such that the coupling head portion 11*a* is protruded to an outside of the tape width direction from the tape side edge of the fastener tape 20 on the element attaching portion 21 side and the upper leg portion 11*b* and the lower leg portion 11*c* are woven into the element attaching portion 21 at the time of weaving the fastener tape 20.

In the fastener stringer 10 according to the present Embodiment as above, the woven texture of the fastener tape 20 is, as shown in FIG. 2, for example, formed by reciprocating a carrier bar (not shown) with respect to a plurality of warp yarns 32 held along the warp direction and inserting the weft 31 into openings between the warp yarns 32. In the present Embodiment, polyester fibers are used for the weft yarn 31 and the plurality of warp yarns 32 forming the fastener tape 20.

In this case, the weft yarn 31 of the fastener tape 20 is disposed to cross the warp yarns 32 in a form of a double yarn in which two weft yarns 31 are aligned. Further, the weft yarn 31 of the present Embodiment is formed of a thick yarn having larger fineness than a first warp yarn 33, described later, disposed in the tape main body portion 22. By using the thick yarn as the weft yarn 31 in this manner, positional shift of the weave (the part where the weft yarn 31 and the warp yarn 32 cross) is less likely to occur in the fastener tape 20, and the tape strength and abrasion resistance of the fastener tape 20 are effectively enhanced.

The tape main body portion 22 of the fastener tape 20 is formed by weaving the weft yarn 31 and the plurality of warp yarns 32 disposed in the form of a double yarn as described above in a plain woven texture. In addition, a weft yarn returning end portion 23 is disposed at an end part of the tape main body portion 22 opposite to the side on which the element attaching portion 21 is formed. The weft yarn returning end portion 23 is formed by connecting a plurality of returning loop portions in the warp direction by hooking the returning loop portion formed of the weft yarn 31 to the returning loop portion of the weft yarn 31 to be inserted at the next position.

In this case, two types of warp yarns 32 (first warp yarn 33 and second warp yarn 34) having different fineness are used as the warp yarns 32 forming the tape main body portion 22. In the conventional woven fastener stringer, for example, the same yarn having the same fineness is commonly used for the warp yarn forming the tape main body portion. On the contrary, in the case of the fastener stringer 10 of the present Embodiment, the warp yarns 32 disposed in the tape main body portion 22 have a plurality of first warp yarns 33 having a predetermined fineness, described later, and a plurality of second warp yarns 34 having a larger fineness than the first warp yarn 33.

Particularly in the present Embodiment, the plurality of second warp yarns 34 having a larger fineness are continuously disposed from the position of the warp yarn 32 adjacent to the weft yarn returning end portion 23 toward a direction to approach the element attaching portion 21 in the tape width direction. Thereby, a thick yarn-continuing area 24 formed of the plurality of second warp yarns 34 is formed in the tape main body portion 22. The thick yarn-continuing area 24 is formed to have a predetermined size (dimension) in the tape width direction.

In this case, it is preferable that the thick yarn-continuing area 24 of the tape main body portion 22 is formed such that a dimension in the tape width direction of the thick yarn-continuing area 24 is ¼ or larger, and particularly ⅓ or larger with respect to the dimension of the entire tape main body portion 22 in the tape width direction. Further, when defined in a specific size, it is preferable that the thick yarn-continuing area 24 is, for example, formed from the position of the warp yarn 32 adjacent to the weft yarn returning end portion 23 to the position that a dimension of the fastener tape 20 on the weft yarn returning end portion 23 side in the tape width direction from the tape side edge is 3.5 mm or larger, and particularly 5 mm or larger.

The thick yarn-continuing area 24 is formed continuously in the region of the tape width direction as described above, the density of the weft yarn 31 and the warp yarn 32 in the region is increased, and the tape strength and the abrasion resistance of the fastener tape 20 can be improved effectively. The high density of the weft yarn 31 and the warp yarn 32 means that the weight of the weft yarn 31 and the warp yarn 32 per unit area is large (heavy).

Since the thick yarn-continuing area 24 of the tape main body portion 22 is provided with an appropriate dimension in the tape width direction, when the fastener stringer 10 is sewn and fixed to a fastener attached member 60 of the product, described later, the position of a sewn portion (sewn line) 61 for sewing the fastener tape 20 and the fastener attached member 60 can be easily set within the thick yarn-continuing area 24 with high yarn density in the tape main body portion 22 or the area close to the thick yarn-continuing area 24.

Then, since the sewn portion 61 of the fastener attached member 60 is formed at the above-described position of the tape main body portion 22 (in particular, the position within the thick yarn-continuing area 24), when the slide fastener 1 receives a lateral pulling force to be pulled toward the outer side in the tape width direction via the fastener attached member 60, for example, the position of the weave in the thick yarn-continuing area 24 can be less likely to be misaligned. As a result, tape strength and abrasion resistance of the fastener tape 20 can be maintained properly. In the present invention, the position and size of the thick yarn-continuing area 24 are not particularly limited, and can be changed arbitrarily depending on the dimension in the tape width direction of the fastener tape 20, and the size of the fastener element 11, the use of the slide fastener 1, etc.

Furthermore, in the tape main body portion 22 of the present Embodiment, a thin yarn-continuing area 25 in which a plurality of first warp yarns 33 thinner than the second warp yarn 34 are continuously disposed is formed between the above-described thick yarn-continuing area 24 and the element attaching portion 21. The tape main body portion 22 of the fastener tape 20 has not only the thick yarn-continuing area 24 formed of the second warp yarn 34 as described above but also the thin yarn-continuing area 25 of the first warp yarn 33, thereby, the tape main body portion 22 can be less likely to be misaligned as mentioned above, and at the same time, good appearance and good touch of the fastener tape 20 can be obtained. In addition, by providing the thin yarn-continuing area 25 in the tape main body portion 22, the manufacturing cost can be reduced and the weight of the fastener stringer 10 can be reduced as compared with the case that the tape main body portion 22 is formed only with the thick yarn-continuing area 24, for example.

In the present invention, the dimension in the tape width direction of the thin yarn-continuing area 25 is not particularly limited. Although at least one first warp yarn 33 is disposed in the tape main body portion 22, two or more first warp yarns 33 are preferably disposed continuously in the tape width direction. As a further preferable configuration, the thin yarn-continuing area 25 of the tape main body portion 22 is, as shown in FIG. 3, for example, provided in such a size that a running region in which the upper flange portion 44 of the slider body 41 runs is disposed in the thin yarn-continuing area 25.

Since the running region of the upper flange portion 44 is positioned on the thin yarn-continuing area 25 of the tape main body portion 22, the fastener tape 20 can be stably inserted into the tape insertion gap 46 without securing a size of the tape insertion gap 46 in the slider body 41 to a large extent. Moreover, the dimension (height dimension) in the upper and lower direction of the upper flange portion 44 is appropriately secured. Furthermore, a step in the height direction can be stably formed between a position of the upper surface of the tape main body portion 22 in the fastener tape 20 and a position of an upper end of the connecting portion 11*d* in the fastener element 11.

As a result, the fastener element 11 can be contacted with the upper flange portion 44, and the position of the element row 12 in the slider body 41 can be stably controlled. Therefore, the fastener element 11 can be stably held in the slider body 41 by preventing the fastener element 11 from popping out in the tape width direction (right and left direction) from inside the slider body 41 via the tape insertion gap 46. Thereby, the right and left element rows 12 can be smoothly coupled or disengaged by the sliding operation of the slider 40.

Furthermore, in the thin yarn-continuing area 25 of the tape main body portion 22, higher flexibility can be easily obtained as compared to the thick yarn-continuing area 24. Since the running region of the upper flange portion 44 is disposed in such a thin yarn-continuing area 25, when the slider 40 is slid in the closing direction (forward) of the slide fastener 1, for example, the right and left fastener elements 11 can be easily coupled. Therefore, the sliding property of the slider 40 can be expected to be improved. Considering the advantages of the thin yarn-continuing area 25 of the tape main body portion 22 as described above, it is preferable that the thin yarn-continuing area 25 is formed such that three or more, preferably five or more first warp yarns 33 are continuously disposed from a position of the warp yarn 32 adjacent to the element attaching portion 21 toward the weft yarn returning end portion 23.

Further, in the fastener stringer 10 of the present Embodiment, the yarn having the larger fineness than the first warp yarn 33 disposed in the tape main body portion 22 is used for the weft yarn 31 and the second warp yarn 34 disposed in the tape main body portion 22 as described above. Particularly in the case of the present Embodiment, yarns having the same fineness are used for the weft yarn 31 and the second warp yarn 34. Thereby, a plain woven texture can be firmly and stably formed by the weft yarn 31 and the second warp yarn 34. In addition, since the same yarns can be used for the weft yarn 31 and the second warp yarn 34, the manufacturing cost can be reduced.

In this case, the fineness of the weft yarn 31 and the fineness of the second warp yarn 34 are set to be twice as large as the fineness of the first warp yarn 33. When the fineness of the first warp yarn 33 is 330 dtex (300 denier), for example, the fineness of the weft yarn 31 and the fineness of the second warp yarn 34 are set at 660 dtex (600 denier). By making the fineness of the weft yarn 31 and the fineness of the second warp yarn 34 twice the fineness of the first warp yarn 33, tape strength of the fastener tape 20 can be improved, and appearance of the woven fastener tape can be improved. Particularly in the present Embodiment, the yarn used for the weft yarn 31 and the yarn used for the second warp yarn 34 are formed in a shape that two yarns (multifilament yarns) used for the first warp yarn 33 are aligned.

Thereby, the fineness of the weft yarn 31 and the second warp yarn 34 and the fineness of the first warp yarn 33 can be easily and reliably made different, and the fineness of each yarn can also be adjusted easily. Further, since the yarns of the weft yarn 31 and the yarns of the second warp yarn 34 can be respectively formed by using the yarns forming the first warp yarn 33, it is possible to further reduce the manufacturing cost. In FIGS. 2 and 3, the weft yarn 31 and the second warp yarn 34 are respectively represented by a single yarn in order to make the arrangement of each yarn easy to be understood. Further, each of the weft yarn 31 and the second warp yarn 34 of the present invention may be formed in a form of one multifilament yarn (twisted yarn).

In the present Embodiment, specific fineness of the weft yarn 31, the first warp yarn 33, and the second warp yarn 34 are set as follows according to, for example, the size of the fastener tape 20.

The fineness of the weft yarn 31 is set at 500 dtex (450 denier) or larger and 1000 dtex (900 denier) or smaller, and preferably 660 dtex (600 denier). The fineness of the first warp yarn 33 is set at 166 dtex (150 denier) or larger and 500 dtex (450 denier) or smaller, and preferably 330 dtex (300 denier). The fineness of the second warp yarn 34 is set at 500 dtex (450 denier) or larger and 1000 dtex (900 denier) or smaller, and preferably 660 dtex (600 denier).

The element attaching portion 21 of the fastener tape 20 is formed of the weft yarn 31 continuously inserted from the tape main body portion 22 and disposed along the lower leg portion 11*c* of each fastener element 11 and the plurality of warp yarns 32. In this case, the warp yarn 32 disposed in the element attaching portion 21 has two head portion-side lower warp yarn for fixing 35 disposed closer to the coupling head portion 11*a* of the fastener element 11 and running on a lower surface side of the lower leg portion 11*c* of each fastener element 11 in the warp direction, six warp yarns for tightening 36 running in the warp direction so as to cross over the lower surface side of the lower leg portion 11*c* and the upper surface side of the upper leg portion 11*b* of the fastener element 11, and two connecting portion-side lower warp yarns for fixing 37 disposed closer to the connecting portion 11*d* of the fastener element 11 and running on the lower surface side of the lower leg portion 11*c* of each fastener element 11 in the warp direction. Further, in the case of the present Embodiment, the same yarn as the first warp yarn 33 of the tape main body portion is used for each warp yarn 32 (coupling head portion-side lower warp yarn for fixing 35, warp yarn for tightening 36, and connecting portion-side lower warp yarn for fixing 37) disposed in the element attaching portion 21.

The weft yarn 31 disposed in the element attaching portion 21 is inserted in a direction perpendicular to the warp direction so as to run in a direction as described below (or run in the opposite direction thereof). That is, at a position where the upper leg portion 11*b* and the lower leg portion 11*c* in the warp direction are disposed, the weft yarn 31 runs in a weft direction from the tape main body portion 22 on the lower surface side of the lower leg portion 11*c* along the lower leg portion 11*c*, interlaces with the two head portion-side lower warp yarns for fixing 35 disposed on the coupling head portion 11*a* side to be returned so as to turn around the circumference of the head portion-side lower warp yarn for fixing 35 disposed the closest to the coupling head portion 11*a*. Further, the returned weft yarn 31 at the head portion-side lower warp yarn for fixing 35 runs on the lower surface side of the lower leg portion 11*c* in the weft direction and is returned to the tape main body portion 22.

The two head portion-side lower warp yarns for fixing 35 in the element attaching portion 21 are disposed adjacent to each other in an area on the coupling head portion 11*a* side of the six warp yarns for tightening 36, and the weft yarn 31 is returned (reversed) by the two head portion-side lower warp yarns for fixing 35 at a position on the coupling head portion 11*a* side.

As shown in FIGS. 2 and 3, the six warp yarns for tightening 36 in the element attaching portion 21 are disposed in the warp direction while being alternately interlaced in a constant cycle respectively so as to interpose the upper leg portion 11*b* of the fastener element 11, the lower leg portion 11*c* of the fastener element 11 and the weft yarn 31 running along the lower leg portion 11*c*. In the present Embodiment, as the two adjacent warp yarns for tightening 36 having symmetrical running direction in the tape top and back direction as one set, three sets of warp yarns for tightening 36 are disposed at a predetermined interval in the tape width direction. Thereby, the plurality of fastener elements 11 (element row 12) can be firmly woven and fixed to the element attaching portion 21 of the fastener tape 20, and the pitches between the woven fastener elements 11 are stabilized at a constant size.

The two connecting portion-side warp yarns for fixing 37 in the element attaching portion 21 are disposed adjacent to each other in an area on the connecting portion 11*d* side of the six warp yarns for tightening 36. These two connecting portion-side lower yarns for fixing 37 are alternately interlaced with the weft yarns 31 to form a weave.

In the present invention, the woven texture of the element attaching portion 21 in the fastener tape 20 is not particularly limited, and, the number of warp yarns for tightening 36 disposed in the element attaching portion 21, for example, can be arbitrarily changed. In addition, as long as the plurality of fastener elements 11 can be firmly fixed, the element attaching portion 21 of the fastener tape 20 can also be formed with a woven texture other than the Embodiment described above.

Figure 4:
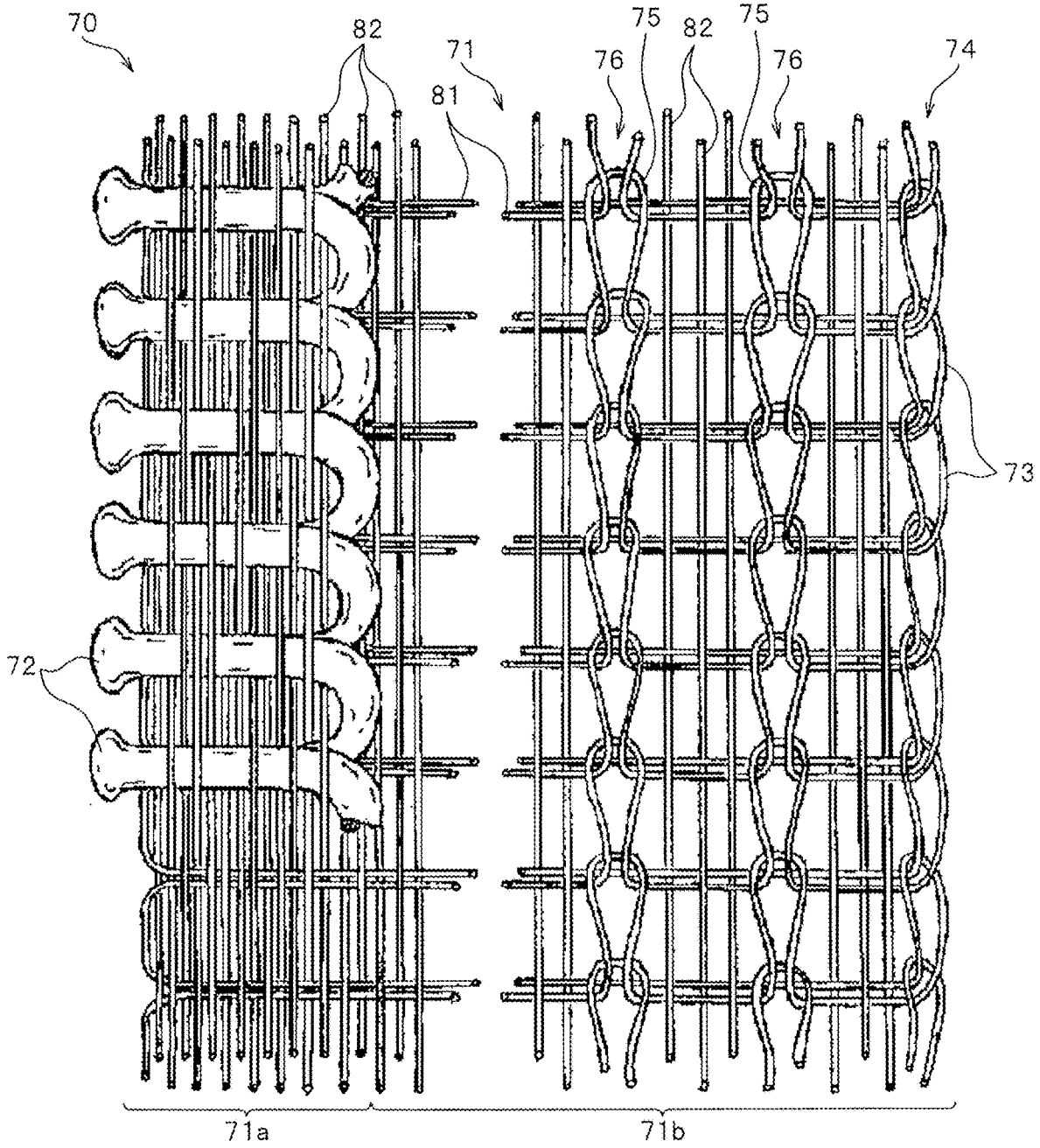
FIG. 4 is a schematic view schematically showing a conventional fastener stringer formed with a weaving structure with one pitch per one-rotation.

The fastener stringer 10 according to the present Embodiment as described above can be manufactured using a loom generally used for manufacturing the conventional ordinary woven fastener stringer, and can be easily manufactured as compared with manufacturing the fastener stringer 70 in which two loop rows 76 are formed in the tape main body portion 71*b* as shown in FIG. 4, for example.

Figure 5:
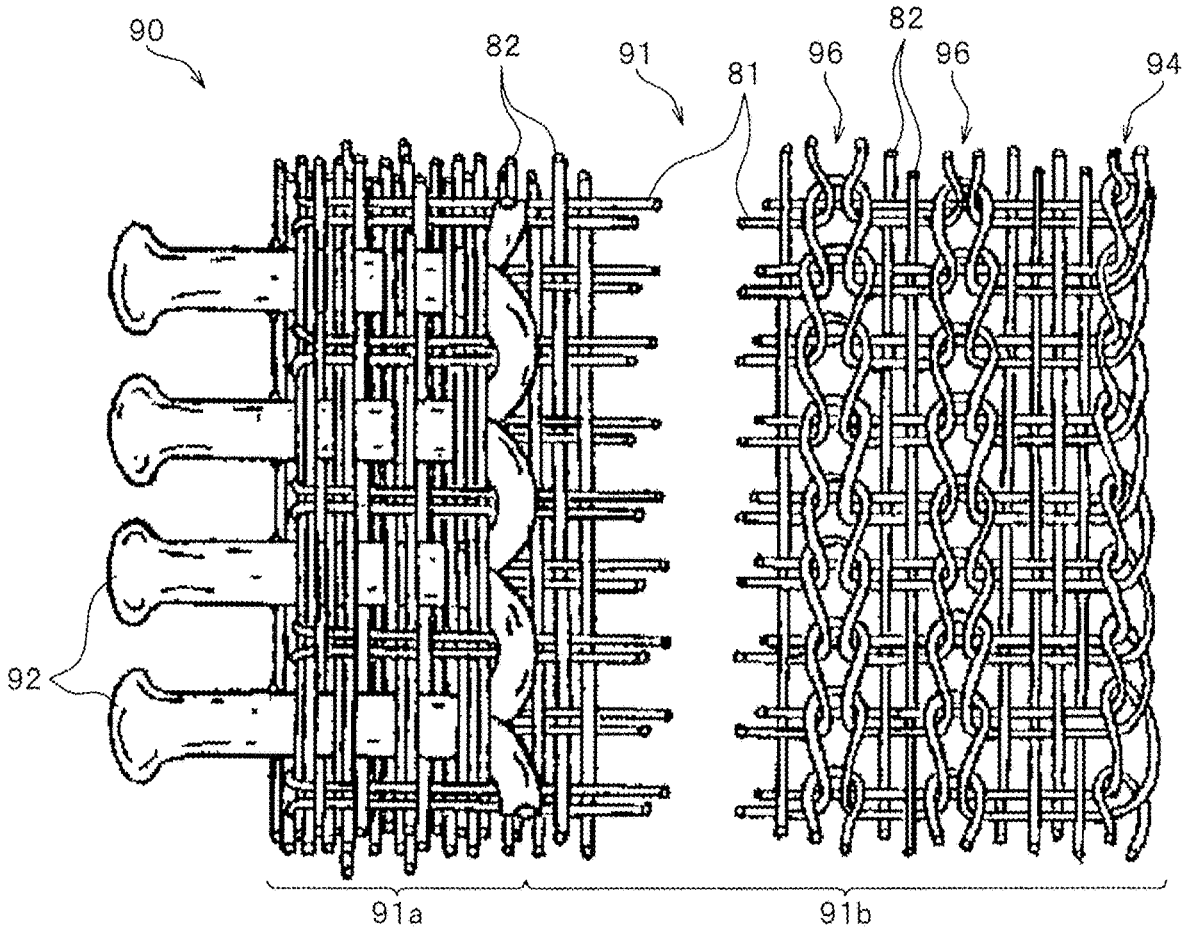
FIG. 5 is a schematic view schematically showing a conventional fastener stringer formed with a structure with one pitch per two-rotation.

In addition, the fastener stringer 10 of the present Embodiment is manufactured with a weaving structure with one pitch per one-rotation as described above. Therefore, the fastener stringer 10 of the present Embodiment can significantly improve the productivity and can reduce the manufacturing cost of the fastener stringer 10 as compared to the fastener stringer 90 adopting the weaving structure with one pitch per two-rotation as shown in FIG. 5, for example.

Furthermore, according to the fastener stringer 10 of the present Embodiment, since the weft yarn 31 and the second warp yarn 34 in the tape main body portion 22 have a fineness larger than the first warp yarn 33 in the tape main body portion 22, the density of the weft yarn 31 and the warp yarn 32 in the tape main body portion (in particular, the density of the weft yarn 31 and the warp yarn 32 in the thick yarn-continuing area 24) can be significantly increased, as compared to the conventional fastener stringer 70 shown in FIG. 4, for example. As a result, positional deviation of weave can be less likely to occur on the fastener tape 20, as described later.

The slide fastener 1 shown in FIG. 1 can be manufactured by using the two fastener stringers 10 of the present Embodiment as described above in a pair. When the slide fastener 1 shown in FIG. 1 is attached to products such as clothing, for example, a fastener attached member 60 of the product (for example, fabric of the clothing) and the tape main body portion 22 of the fastener tape 20 are overlapped, and the overlapped part is sewing-processed using a sewing machine.

As a result, as shown in FIG. 3, the fastener tape 20 and the fastener attached member 60 of the product are sewn together with the sewn portion (sewn line) 61 formed by the sewing machine, so that the slide fastener 1 can be attached to the product stably. In this case, it is preferable that the thick yarn-continuing area 24 in the tape main body portion 22 of the fastener tape 20 is overlapped with the fastener attached member 60 of the product, and the thick yarn-continuing area 24 is sewn to the fastener attached member 60 with the sewn portion 61.

Then, when using the product to which the slide fastener 1 shown in FIG. 1 is attached as described above (when wearing clothes, for example) and in a case that the product is pulled etc., thereby the slide fastener 1 receives a lateral pulling force to be pulled toward the outside in the tape width direction of the fastener tape 20, force is applied to the tape main body portion 22 of the fastener tape 20 via the sewn portion 61 so as to shift the position of the weave outward in the tape width direction.

Even in such a case, in the slide fastener 1 shown in FIG. 1, the fastener tape 20 is formed such that the yarn density of the tape main body portion 22 (particularly the thick yarn-continuing area 24) is increased to prevent occurrence of misalignment. At the same time, the tape main body portion 22 (particularly the thick yarn-continuing area 24) of the fastener tape 20 is sewn to the fastener attached member 60 of the product. Therefore, even when the above-described force is applied to the tape main body portion 22 of the fastener tape 20 via the sewn portion 61, the tape main body portion 22 (particularly the thick yarn-continuing area 24) is less likely to be misaligned, thereby the misalignment of the weave can be suppressed (see Embodiment 1 described later). As a result, it is possible to effectively suppress lowering of the tape strength and lowering of the abrasion resistance of the fastener tape 20 due to the misalignment of the fastener tape 20.

In the fastener stringer 10 of the Embodiment described above, the tape main body portion 22 of the fastener tape 20 has the thick yarn-continuing area 24 disposed adjacent to the weft yarn returning end portion 23 and the thin yarn-continuing area 25 disposed adjacent to the element attaching portion 21. In the tape main body portion 22 of the fastener tape 20 in the present invention, however, a thin yarn-continuing area 25 formed of the first warp yarn 33 may be further provided between the weft yarn returning end portion 23 and the thick yarn-continuing area 24. A thick yarn-continuing area 24 formed of the second warp yarn 34 may also be further provided between the thin yarn-continuing area 25 and the element attaching portion 21.

Further, in the present invention, as long as the weft yarn 31 of the fastener tape 20 is formed thicker than the first warp yarn 33 of the tape main body portion 22, it is possible to weave a fastener tape 20 having a tape main body portion 22 in which the first warp yarn 33 and the second warp yarn 34 thicker than the first warp yarn 33 are disposed alternately in the tape width direction and the thick yarn-continuing area 24 and the thin yarn-continuing area 25 are not provided. Further, it is also possible to weave a fastener tape 20 using only the first warp yarn 33 without using the second warp yarn 34 to the tape main body portion 22.

EMBODIMENTS

Hereinafter, the present invention will be more specifically described by showing Embodiments 1 and 2 and a Comparative Example.

Embodiment 1

A yarn having a fineness of 330 dtex (300 denier) was used as the first warp yarn 33 of the tape main body portion 22 and each warp yarn 32 disposed in the element attaching portion 21, and a yarn having a fineness of 660 dtex (600 denier) was used as the weft yarn 31 and the second warp yarn 34 of the tape main body portion 22 to manufacture a fastener stringer 10 according to the above-described Embodiment. In this case, the fastener stringer 10 of Embodiment 1 is formed with the weaving structure with one pitch per one-rotation. Further, the weft 31 and the second warp yarn 34 have a configuration in which two yarns used for the first warp yarn 33 are aligned.

In the tape main body portion 22 of the manufactured fastener stringer 10, a thick yarn-continuing area 24 in which the second warp yarns 34 are continuously disposed in the tape width direction is formed. The thick yarn-continuing area 24 is, in the tape width direction of the tape main body portion 22, formed from a position of the warp yarn 32 adjacent to the weft yarn returning end portion 23 to a position of the warp yarn 32 separated by 4.5 mm in the tape width direction based on a position of the connecting portion 11*d* of the fastener element 11 (specifically, an end edge position of the connecting portion 11*d* on the tape main body portion 22 side).

Then, the manufactured fastener stringers 10 of Embodiment 1 were used in a set of two to manufacture a slide fastener 1 shown in FIG. 1, and further, the right and left fastener tapes 20 in the obtained slide fastener 1 were sewn to the fastener attached member 60 of the product using a sewing machine. At this time, the position of the sewn portion 61 formed by the sewing machine was set at the position 5 mm away from the connecting portion 11*d* of the fastener element 11 in the tape width direction. Therefore, in Embodiment 1, the thick yarn-continuing area 24 in the tape main body portion 22 of the fastener tape 20 and the fastener attached member 60 of the product are sewn together with the sewn portion 61.

Thereafter, in a state that the slide fastener 1 is closed (a state that the right and left element rows 12 are coupled), a lateral pulling force was applied to the right and left fastener stringers 10 of the slide fastener 1 by pulling the right and left fastener attached members 60 of the product toward an outside in the right and left direction with a predetermined load. Furthermore, the state that the lateral pulling force was applied to the fastener stringers 10 was maintained for a predetermined time.

After a predetermined time has passed, the slide fastener 1 is removed from the fastener attached members 60 of the product while removing the lateral pulling force. Thereafter, the position of the weave at the point where the sewn portion 61 of the fastener tape 20 is formed was identified, and the length (i.e., the size of the misalignment) at which the position of the weave is shifted from the normal position (the position of the weave before the lateral pulling force was applied) was measured. The size of such a misalignment was measured at ten different positions on the straight line on which the sewn portion 61 was formed in the fastener tape 20 to determine the average value. As a result, the average value of the size of the misalignment in Embodiment 1 was 1.88 mm.

Embodiment 2

Only a warp yarn having a fineness of 330 dtex (300 denier) was used as the warp yarn disposed in the tape main body portion of the fastener tape without using the second warp yarn 34 as in the above-described Embodiment 1 to manufacture a fastener stringer. Therefore, in the Embodiment 2, the fineness of the thickest warp yarn disposed in the tape main body portion of the fastener tape is 330 dtex (300 denier). The fastener stringer of Embodiment 2 is formed in the same manner as in the case of the above-mentioned Embodiment 1 except having changed the fineness of the warp yarn disposed in the tape main body portion.

The manufactured fastener stringer of Embodiment 2 was used to manufacture a slide fastener in the same manner as in Embodiment 1, and further, the slide fastener was sewn to the fastener attached member 60 of the product using a sewing machine. Thereafter, the size of misalignment was measured under the same conditions as in Embodiment 1 to determine the average value. As a result, the average value of the size of the misalignment in Embodiment 2 was 3.42 mm.

Comparative Example

Only a warp yarn having a fineness of 330 dtex (300 denier) is used as a warp yarn disposed in the tape main body portion of the fastener tape, and a yarn having a fineness of 330 dtex (300 denier) is used as a weft yarn of the fastener tape to manufacture a fastener stringer. Therefore, in the Comparative Example, the fineness of the thickest warp yarn disposed in the tape main body portion of the fastener tape is 330 dtex (300 denier). The fastener stringer of Comparative Example is formed in the same manner as in the case of the above-mentioned Embodiment 1 except having changed the fineness of the warp yarn disposed in the tape main body portion and the fineness of the weft yarn.

The manufactured fastener stringer of Comparative Example was used to manufacture a slide fastener in the same manner as in Embodiment 1, and further, the slide fastener was sewn to the fastener attached member 60 of the product using a sewing machine. Thereafter, the size of misalignment was measured under the same conditions as in Embodiment 1 to determine the average value. As a result, the average value of the size of the misalignment in Comparative Example was 4.38 mm.

Regarding the fastener stringer of Embodiment 1, Embodiment 2, and Comparative Example, the fineness of the weft yarn forming the fastener tape and the fineness of the thickest warp yarn disposed in the tape main body portion of the fastener tape are shown in Table 1 below, and the result of the average values of the size of the misalignment are also shown.

TABLE 1

| | Fineness of weft yarn (dtex) | Fineness of thickest warp yarn disposed in tape main body portion (dtex) | Size of misalignment (mm) |
|---|---|---|---|
| Embodiment 1 | 660 | 660 | 1.88 |
| Embodiment 2 | 660 | 330 | 3.42 |
| Comparative Example | 330 | 330 | 4.38 |

As shown in Table 1, in the fastener stringer of Embodiment 2, the misalignment was able to be suppressed to a small extent by making the fineness of the weft yarn larger than the case of the fastener stringer of Comparative Example. As a result, it was confirmed that the misalignment of the fastener tape can be suppressed to a small extent by weaving the fastener tape using the thick weft yarn of 660 dtex as compared to the case that the thin weft yarn of 330 dtex is used.

Furthermore, in the fastener stringer 10 of Embodiment 1, a plurality of warp yarns 32 (second warp yarns 34) having a larger fineness than those of the fastener stringer of Embodiment 2 are continuously disposed in the tape main body portion 22 of the fastener tape 20, thereby, misalignment was able to be further suppressed to a small extent. Accordingly, it was confirmed that the thick weft yarn 31 of 660 dtex is disposed in the fastener tape 20, and the thick second warp yarns 34 of 660 dtex are disposed in the tape main body portion 22 of the fastener tape 20, thereby, misalignment of the fastener tape 20 can be further suppressed effectively.

REFERENCE SIGNS

1: Slide fastener
10: Fastener stringer
11: Fastener element
11*a*: Coupling head portion
11*b*: Upper leg portion
11*c*: Lower leg portion
11*d*: Connecting portion
12: Element row
20: Fastener tape
21: Element attaching portion (Tape side edge portion)

22: Tape main body portion
23: Weft yarn returning end portion
24: Thick yarn-continuing area
25: Thin yarn-continuing area
31: Weft yarn
32: Warp yarn
33: First warp yarn
34: Second warp yarn
35: Head portion-side lower warp yarn for fixing
36: Warp yarn for tightening
37: Connecting portion-side lower warp yarn for fixing
40: Slider
41: Slider body
42: Upper blade
43: Lower blade
44: Upper flange portion
45: Tab attaching portion
46: Tape insertion gap
49: Tab
51: First stop
52: Second stop
60: Fastener attached member
61: Sewn portion (Sewn line)

The invention claimed is:

1. A fastener stringer comprising a fastener tape woven with a weft yarn and a plurality of warp yarns and a plurality of continuous fastener elements fixed by weaving to the fastener tape along a tape length direction at the same time of weaving of the fastener tape, in which the fastener tape is provided with a tape main body portion and an element attaching portion which extends in a tape width direction from one side edge part of the tape main body portion and to which the fastener elements are fixed, and the fastener stringer having a weaving structure in which the weft yarn is inserted once for each pitch of the fastener elements wherein:

the weft yarn has a fineness larger than that of at least a part of the warp yarns disposed in the tape main body portion of the fastener tape, the warp yarns disposed in the tape main body portion include first warp yarns having predetermined fineness and second warp yarns having a fineness larger than that of the first warp yarn, and the weft yarn has a fineness larger than that of the first warp yarns.

2. The fastener stringer according to claim 1, wherein:

the tape main body portion has a thick yarn-continuing area in which a plurality of the second warp yarns are continuously disposed along a tape width direction.

3. The fastener stringer according to claim 2, wherein:

the fastener tape has a weft yarn returning end portion which is disposed at the other side edge part of the tape main body portion and at which the weft yarn forms a loop and returns, the thick yarn-continuing area is disposed in a tape width direction from a position of a warp yarn adjacent to the weft yarn returning end portion, and a thin yarn-continuing area in which a plurality of the first warp yarns are continuously disposed is disposed between the thick yarn-continuing area and the element attaching portion.

4. The fastener stringer according to claim 1, wherein:

the weft yarn and the second warp yarns have a fineness twice as large as the fineness of the first warp yarns.

5. The fastener stringer according to claim 4, wherein:

the weft yarn and the second warp yarns have a configuration in which two yarns forming the first warp yarns are aligned.

6. The fastener stringer according to claim 1, wherein:

the fineness of the weft yarn is in a range from 500 dtex to 1000 dtex, the fineness of the first warp yarns is in a range from 166 dtex to 500 dtex, and the fineness of the second warp yarns is in a range from 500 dtex to 1000 dtex.

* * * * *